US005706555A

United States Patent [19]

Furtner

[11] Patent Number: 5,706,555

[45] Date of Patent: Jan. 13, 1998

[54] ARTICULATION ARRANGEMENT FOR DETACHABLY CONNECTING TWO WALL PARTS

[75] Inventor: Josef Furtner, Enns, Austria

[73] Assignee: Steiner Freizeitmöbel Gesellschaft m.b.H. & Co. KG, Pinsdorf/Aurachkirchen, Austria

[21] Appl. No.: 722,316

[22] Filed: Sep. 27, 1996

Related U.S. Application Data

[62] Division of Ser. No. 436,358, filed as PCT/AT93/00166, Oct. 29, 1993, Pat. No. 5,588,549.

[30] Foreign Application Priority Data

Nov. 18, 1992 [AT] Austria ..... 2284/92

[51] Int. Cl.[6] ..... E05D 7/10

[52] U.S. Cl. ..... 16/267; 16/257; 16/261; 16/265

[58] Field of Search ..... 16/257, 259, 261, 16/265, 266, 260, 267

[56] References Cited

U.S. PATENT DOCUMENTS

| | | | |
|---|---|---|---|
| 2,734,222 | 2/1956 | Kiba | 16/267 |
| 4,084,214 | 4/1978 | Eppich | 16/267 |
| 4,584,739 | 4/1986 | Konen | 16/266 |
| 4,850,081 | 7/1989 | Grant | 16/266 |
| 4,916,968 | 4/1990 | Kabaya | 16/267 |

FOREIGN PATENT DOCUMENTS

| | | | |
|---|---|---|---|
| 3414401 | 10/1985 | Germany | 16/266 |

*Primary Examiner*—Chuck Mah
*Assistant Examiner*—Donald M. Gurley
*Attorney, Agent, or Firm*—Collard & Roe, P.C

[57] ABSTRACT

An articulation arrangement for detachably connecting two wall parts of a container, each of the wall parts having a surface and an underside, one of the wall parts having a side face extending between the surface and the underside, and the other wall part comprising a marginal strip having an arcuate surface defining an arc of a circle about an axis extending parallel to a longitudinal direction of the marginal strip, the arc extending from the surface of the other wall part to the underside thereof and the marginal strip having a thickness extending from the surface to the underside of the other wall part, and the side face of the one wall part facing the arcuate surface of the marginal strip. The articulation arrangement comprises a groove in the underside of the marginal strip and extending parallel to the longitudinal direction thereof, the groove having a bottom extending semicircularly about said axis, the side face being spaced from the axis a distance at least approximately corresponding to the radius of the arc of a circle of the arcuate surface, the marginal strip further defining a recess extending in the longitudinal direction and leading from the arcuate surface to the groove, a pivot pin coaxially held in the groove for pivoting about said axis and for axial displacement therein whereby the one wall part may be pivoted about the axis from a first position wherein the one wall part extends perpendicularly to the other wall part to a second position wherein the wall parts are coplanar, and a connecting web connecting the side face to the pivot pin, the connecting web having a width extending in the longitudinal direction and fitting through the recess.

9 Claims, 4 Drawing Sheets

ARTICULATION ARRANGEMENT FOR DETACHABLY CONNECTING TWO WALL PARTS

This is a division of my U.S. patent application Ser. No. 08/436,358, filed as PCT/AT93/00166, Oct. 29, 1993, now U.S. Pat. No. 5,588,549.

The invention relates to an articulation arrangement for detachably connecting two walls parts.

Such wall parts may form the walls of containers constructed so as to be able to be dismantled or able to be folded into themselves, so as to take up a small transportation volume whilst being transported in empty state.

In a known container—according to EP-A-0 211 795—the side walls and end walls have a plurality of cooperating tongues and slits, with which these are attached to each other in circumferential direction of the container and which position the lateral and end walls in position with respect to each other, in which they may be connected with the base. A disadvantage in this construction is that in dismantled state the walls and the base are separate from each other as individual parts and therefore, before being used, the parts have to be sorted and, moreover, the risk exists that individual parts are lost.

In addition a container—according to EP-A-0 443 327—is known, which is able to be folded together into itself and in which four side walls are mounted so as to be orientable on the base and which in the folded in state brings about a multi-layered arrangement of the base and of the side walls. In this embodiment, it is disadvantageous that the articulation arrangements between the side walls and the base, depending on which position the side wall forms in folded in state with respect to the base, have to have a different construction. This requires very expensive and costly tools for the production of these containers and a high risk of fracture of the articulation arrangement under load.

An additionally known construction of a container—according to DE-OS 34 44 477—consists in that on a base part, wall parts are articulated on its encircling marginal sides, which wall parts are able to be folded from a vertical position in righted state to the base part into approximately the plane of the base part. The articulation of the wall parts onto the base part takes place in this embodiment by means of impressions in the material along the fold lines, which form so-called film hinges. In the righted state, the wall parts are positioned by means of connecting arrangements, in particular plug connections, in their position with respect to each other. A disadvantage in this embodiment is that through the impressions, the stability of these containers is impaired and therefore these are better suited for application in apparatus construction for the incorporation of functional elements etc. than for use as transport containers of commodities and goods.

It is now an object of the invention to create hinges for the walls of a container which takes up a small transportation volume or storage volume in empty state and which, when used as a transport container is distinguished by a large holding capacity both in volume and also in weight of the goods to be carried, and which requires a small number of components.

In a container comprising two wall parts, each of the wall parts having a surface and an underside, one of the wall parts having a side face extending between the surface and the underside, and the other wall part comprising a marginal strip having an arcuate surface defining an arc of a circle about an axis extending parallel to a longitudinal direction of the marginal strip, the arc extending from the surface of the other wall part to the underside thereof and the marginal strip having a thickness extending from the surface to the underside of the other wall part, and the side face of the one wall part facing the arcuate surface of the marginal strip, the present invention provides an articulation arrangement for detachably connecting the wall parts, which comprises a groove in the underside of the marginal strip and extending parallel to the longitudinal direction thereof, the groove having a bottom extending semicircularly about said axis, the side face being spaced from the axis a distance at least approximately corresponding to the radius of the arc of a circle of the arcuate surface, the marginal strip further defining a recess extending in the longitudinal direction and leading from the arcuate surface to the groove, a pivot pin coaxially held in the groove for pivoting about said axis and for axial displacement therein whereby the one wall part may be pivoted about the axis from a first position wherein the one wall part extends perpendicularly to the other wall part to a second position wherein the wall parts are coplanar, and a connecting web connecting the side face to the pivot pin, the connecting web having a width extending in the longitudinal direction and fitting through the recess.

Such an articulation arrangement makes it possible to pivot a side wall attached to a base wall of a container from an erected position to a position in which the walls lie in the same plane so that the volume of the container is substantially reduced.

According to a preferred embodiment, the pivot pin has a length at least approximately corresponding to twice the width of the recess, the pivot pin having opposite end portions projecting outwardly from the connecting web. A stop is arranged in the groove adjacent one of the pivot pin end portions whereby the axial displacement of the pivot pin is delimited. The stop is preferably elastically deformable for movement in a direction extending transversely to the longitudinal direction. This provides a long-lasting and wear-resistant device against axial displacement of the pivot pin and an unintentional disengagement of the pivot pin from the groove. The elasticity of the stop facilitates the assembly of the articulation arrangement.

For a better understanding of the invention, the latter is explained in further detail with the aid of a now preferred embodiment illustrated in the drawings, in which.

Figure 1:
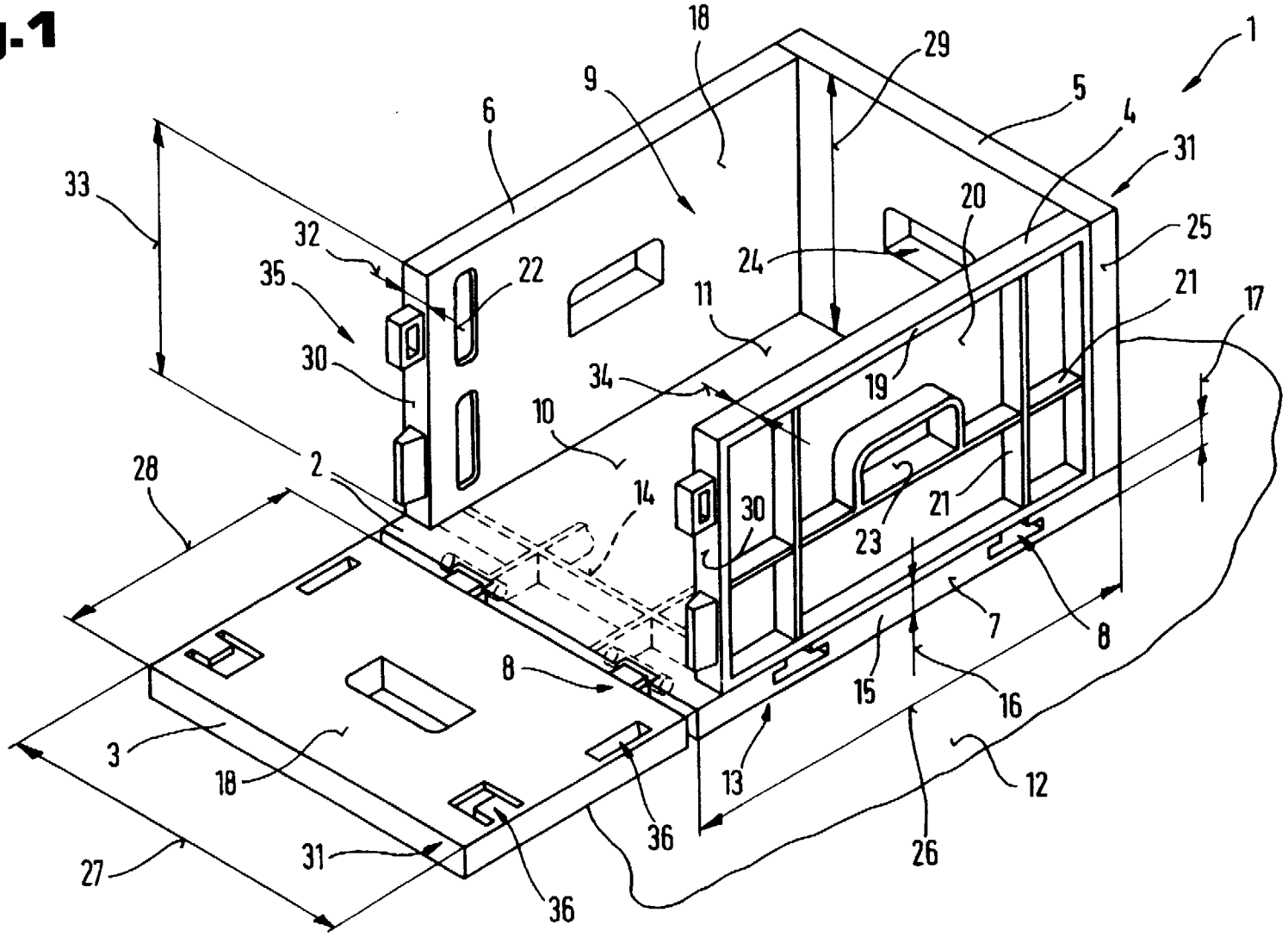
FIG.1 shows a container with articulation arrangements according to the invention, in diagrammatic representation.

In FIG. 1 a container 1 is shown. This consists of a base wall part 2 and side wall parts 3,4,5,6, which are pivotally connected with the circumferential longitudinal and transverse side faces 7 of base 2 by means of articulation arrangements 8. These articulation arrangements 8, enable the side wall parts 3,4,5,6 to be oriented from a position forming approximately a right angle with the base 2 approximately into a coplanar position with the base 2.

The base 2 has a base plate II which has an upper face 10 facing an interior 9 of the container 1 and an underside 13 facing away from the surface 10 and facing a support face 12, which has cross-pieces 14 for reinforcement. These are integral with the base plate 11 and with marginal strips 15 forming the longitudinal and transverse side faces 7, in particular are formed thereon and onto the base plate 11. A height 16 of the marginal strips 15 and of the cross-pieces 14 corresponds approximately to a total thickness 17 of the base 2.

Side wall parts 3,4,5,6 are formed, similar to the base 2, by wall plates 18 facing the interior 9, which wall plates 18 have marginal strips 19 arranged in circumferential direction, which project over an outer face 20 of the wall plate 18 facing away from the interior 9 and on which, additionally, cross-pieces 21 are arranged, which are integral with the marginal strips 19 and the wall plate 18. The side wall parts 3,4,5,6, moreover, preferably have openings 22 which serve for the ventilation of goods carried in the container 1. Furthermore, handle openings 24 are provided in the side wall parts 3,4,5,6, which openings are edged by cross-piece-like reinforcement elements 23.

If the side wall parts 3,4,5,6 are in their righted position, in which they form an angle of 90° with the base 2, then an outer plane 25, defined by the marginal strips 19 and, the cross-pieces 21, has the same length 26 and width 27 as the base 2. Thereby, in the region of a height 28 of the side wall parts, which corresponds to a depth 29 of the container 1, an overlapping region 31 is formed by end faces 30 formed by the marginal strips 19 and wall plates 18 facing the same. Its width 32 corresponds to a height 33 of the marginal strips 19 or a total thickness 34 of the side wall parts 4,6 running at right angles thereto.

Connecting arrangements 35 project over the end faces 30 in the direction of the side wall parts 3,5 adjoining in the overlapping region 31 and mountings 36 are associated therein cooperate with the connecting arrangements.

Figure 2:
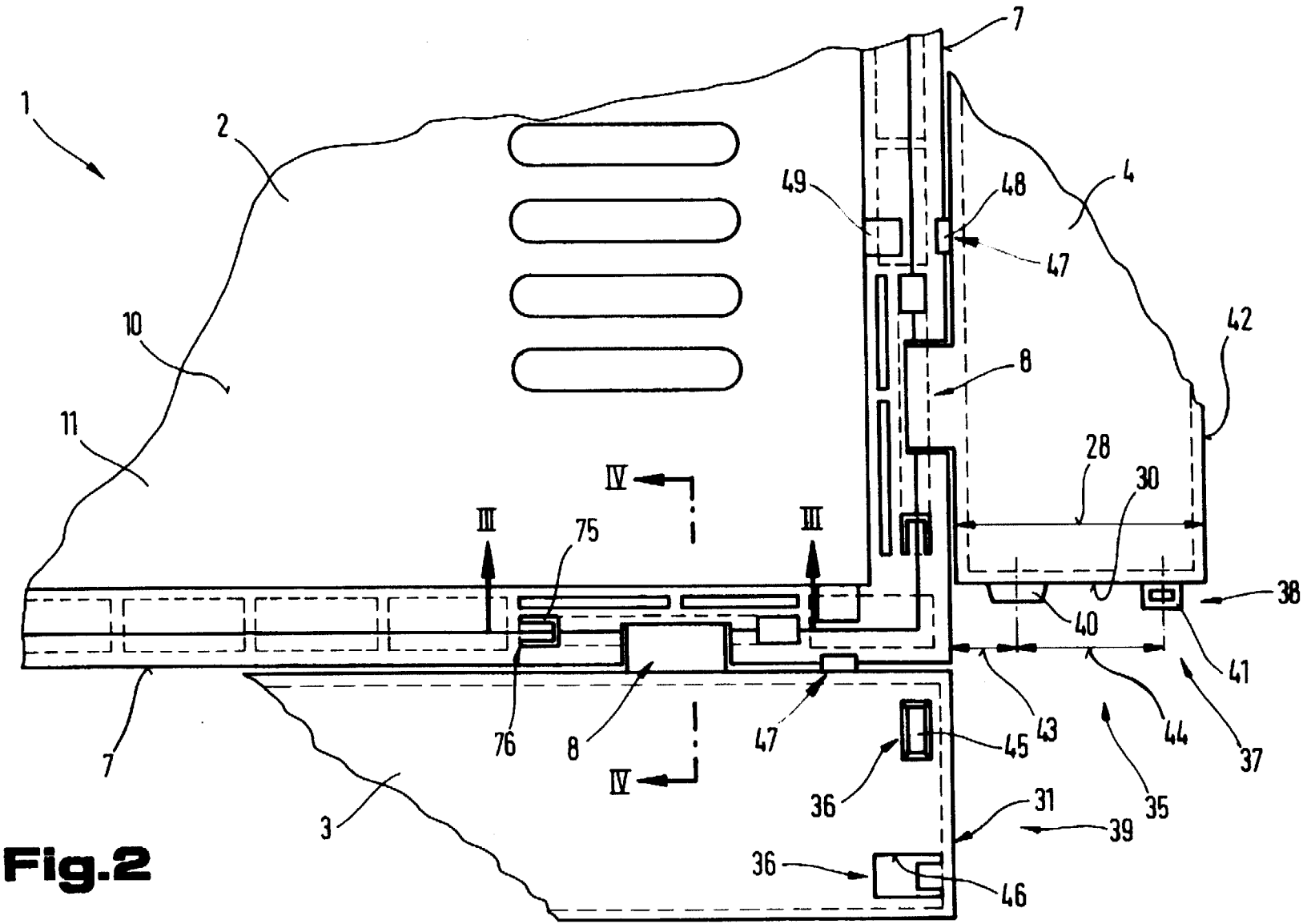
FIG. 2 shows a partial region of the base of the container according to the invention with side wall parts tilted into a plane with the base.

In FIG.2 a partial region of the container 1 is illustrated with the base 2, and the side wall parts 3,4 attached thereto along longitudinal and transverse side faces 7 by the articulation arrangements 8. These side wall parts are shown tilted in their position forming a plane with the base 2. In the position of use the side wall parts 3,4,5,6 form with the base 2 an angle of 90°. The side wall part 4 has the connecting arrangement 35, with which are associated the mountings 36 of the side wall part 3 in the overlapping region 31. The connecting arrangement 35 is formed by a coupling device 38 having centering and/or locking elements 37, which cooperate with the mountings 36, formed by centering and/or locking mountings 39. The centering and/or locking elements 37 comprise, in the direction of the height 28 of the side wall parts 4 or 6, a strip-shaped centering extension 40 spaced from a coupling extension 41, which project from the end side face 30 of the side wall part 4 or 6 in the direction of the adjoining side wall part 3 or 5. Preferably the centering extension 40 is arranged adjacent to the base 2, whereas the coupling extension 41 is, associated with the region of an upper edge 42 of the side wall part 4. Corresponding to a mean distance 43 of the centering extension 40 from the longitudinal and transverse side face 7 and a mean distance 44 between the centering extension 40 and the coupling extension 41, a centering mounting 45 and a coupling opening 46 of the centering- and/or locking mounting 39 are arranged in the overlapping region 31 of the associated side wall part 3.

In the region of the longitudinal and transverse side faces 7 and adjacent to the articulation arrangements 8, elements of a locking device 47 for the side wall parts 3,4,5,6 are arranged, which are constructed in the form of stops 48, which cooperate with support faces 49 in the surface 10 of the base plate 11. Through this locking device 47, an effective delimitation of the swivel angle of the side wall parts 3,4,5,6 is ensured in the direction of the base 2. Stops 48 and the support faces 49, prevent a free tilting of the erected side wall parts 3,4,5,6 into the plane of the base or make it is only possible only after overcoming a resistance provided by a crank-shaped construction of the support face 49.

Figure 3:
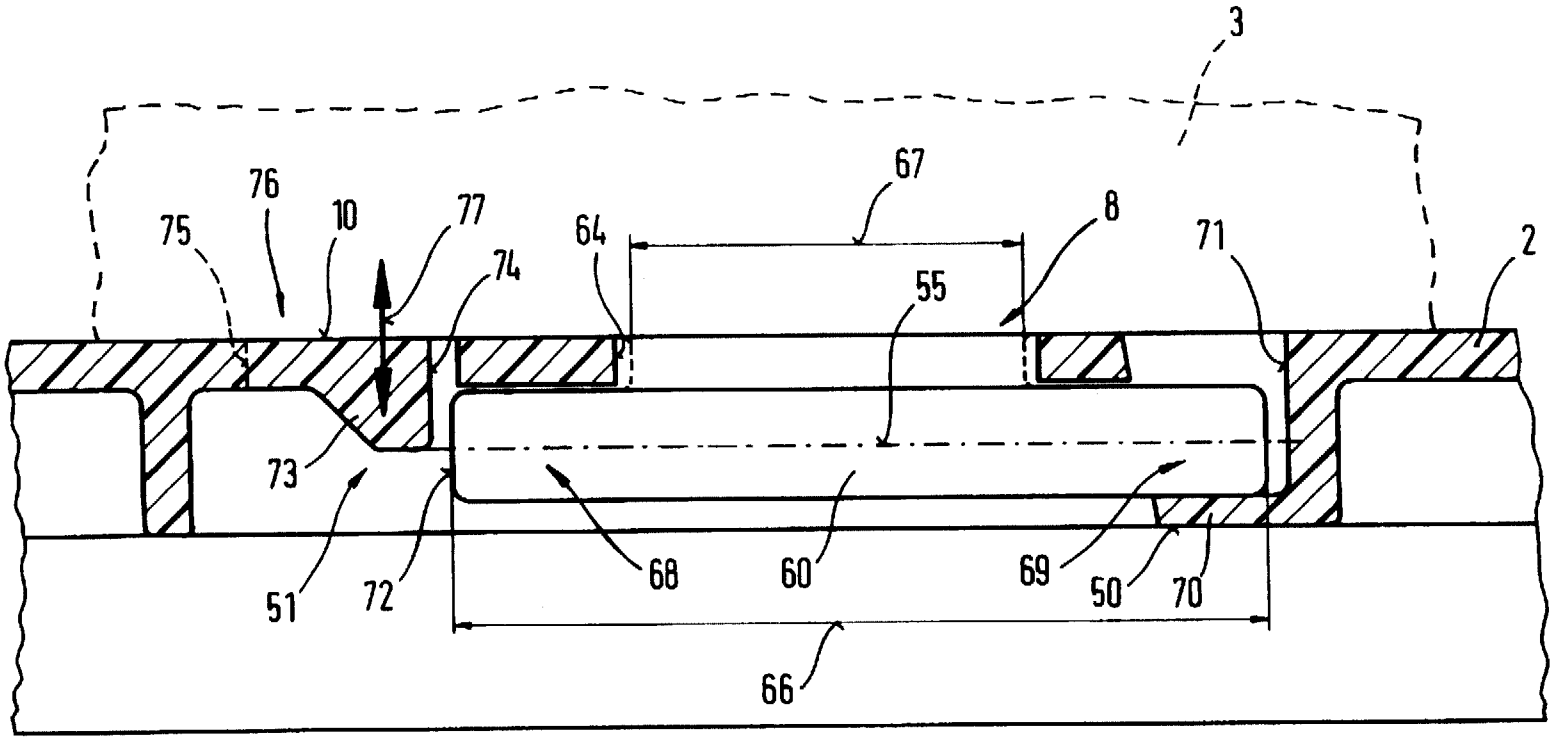
FIG. 3 shows an articulation arrangement between the base and a side wall part of the container according to the invention, in section, according to lines III—III in FIG. 2.
Figure 4:
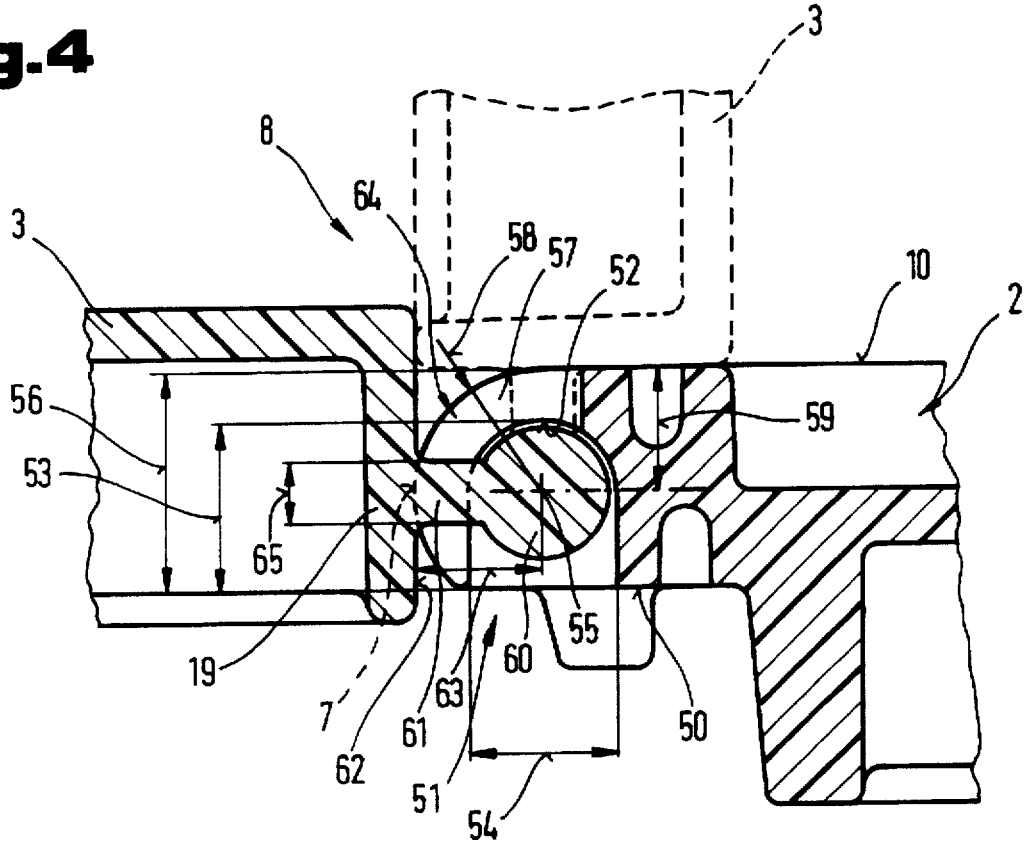
FIG. 4 shows the articulation arrangement in section, according to lines IV—IV in FIG. 2.

In FIG. 3 and 4 the articulation arrangement 8 is shown between the side wall parts 3,4,5,6, for example for the side wall part 3 and the base 2. In these illustrations, the side wall part 3 is shown in its position forming a plane with the base 2 in solid lines, and in its position assuming an angle of 90° with the base in broken lines. The bottom 2 has a groove 51 running parallel to the side face 7 on an underside 50 facing away from the surface 10. A groove bottom 52 facing the surface 10 has a semicircular shape, and a depth 53 of the groove 51 is greater than a width 54. A longitudinal central axis 55 of the articulation arrangement 8 running parallel to the longitudinal and transverse side faces 7 and the surface 10 is approximately in the centre of a thickness 56 of marginal strip 57 of base 2 forming the longitudinal and transverse side face 7. In FIG. 4, base 2 is shown to comprise a rim projecting from underside 50 of the bottom to support the bottom on a surface, such as a table. The longitudinal and transverse side face 7 is rounded in a circular shape in a direction running transversely to its longitudinal extent, and a radius 58 proceeding from the longitudinal central axis 55 corresponds to a distance 59 between the surface 10 of the base 2 and the longitudinal central axis 55. Pivot pin 60 is arranged coaxially in the groove 51 and extends in the direction of the longitudinal central axis 55. Connecting web 61 projects from side face 62 in the direction of marginal strip 57 and connects pivot pin to side face 62 so that wall part 3 may move with the pivot pin. A distance 63 between the side face 62 and the longitudinal central axis 55 corresponds approximately to the radius 58, of the circularly rounded longitudinal and transverse side face 7.

In the region of the connecting web 61, the marginal strip 57, defining the groove 51 is provided with a recess 64 to hold the connecting web 61. Recess 64 extends from the longitudinal and transverse side face 7 by the distance 63, plus half the dimension of a thickness 65 of the connecting web 61, in the direction of the the interior space 9. In the direction of its longitudinal extent the pivot pin 60 has a length 66, which corresponds approximately to twice a width 67 of the connecting web 61. End portion 68,69 of the pivot pin 60 project the connecting web 61, and pivotally secure the side wall part 3 is in the groove 51. The groove 51 is closed in one of the end regions 68,69, as illustrated, in the end region 69, at the underside 50 by a holding extension 70, which extends over width 54 of groove 51 whereby a receiving chamber 71 for the end region 69 of the pivot pin 60 is formed.

There is associated with an end face 72 of the pivot pin 60, opposite to the receiving chamber 71, a stop 73 delimiting the groove 51 in its longitudinal extent, which stop is formed on the base 2 and extends from the surface 10 into the region of the longitudinal central axis 55 and, facing the end face 72, forms a stop face 74, which prevents an axial displacement of the pivot pin 60. Stop 73 is elastically deformable via a weakened region 76, formed by slits 75, in vertical direction relative to based a double arrow 77. This facilitates the assembly of the articulation arrangement 8 through introduction of the pivot pin 60 into the groove 51 and the receiving chamber 71. Through swinging the stop 73 out from its locking position for the pivot pin 60, a separation of the articulation arrangement 8 is made possible and hence the side wall parts 3,4,5,6 are separated from the base 2.

I claim:

1. An articulation arrangement for detachably connecting two wall parts of a container, each of the wall parts having a surface and an underside, one of the wall parts having a side face extending between the surface and the underside, and the other wall part comprising a marginal strip integral with the other wall part and defining an outer border of the other wall part, the marginal strip having an arcuate surface defining an arc of a circle about an axis extending parallel to a longitudinal direction of the marginal strip, the arc extending from the surface of the other wall part to an underside of the marginal strip and the marginal strip having a thickness extending from the surface to the underside of the other wall part, and the side face of the one wall part facing the arcuate surface of the marginal strip, the articulation arrangement comprising a groove in the underside of the marginal strip and extending parallel to the longitudinal direction thereof, the groove having a bottom extending semicircularly about said axis, the side face being spaced from the axis a distance at least approximately corresponding to the radius of the arc of a circle of the arcuate surface, the marginal strip further defining a recess extending in the longitudinal direction and leading from the arcuate surface to the groove, a pivot pin coaxially held in the groove for pivoting about said axis and for axial displacement therein whereby the one wall part may be pivoted about the axis from a first position wherein the one wall part extends perpendicularly to the other wall part to a second position wherein the wall parts are coplanar, and a connecting web connecting the side face to the pivot pin, the connecting web having a width extending in the longitudinal direction and fitting through the recess.

2. The articulation arrangement of claim 1, wherein the groove has a depth exceeding the width thereof.

3. The articulation arrangement of claim 1, wherein said axis extends at least approximately along the center of the thickness of the marginal strip.

4. The articulation arrangement of claim 1, wherein the surface of the other wall part is spaced from said axis a distance at least approximately corresponding to the radius of the arc of a circle defined by the arcuate surface.

5. The articulation arrangement of claim 1, wherein the pivot pin has a length at least approximately corresponding to twice the width of the recess, the pivot pin having opposite end portions projecting outwardly from the connecting web.

6. The articulation arrangement of claim 5, further comprising a stop arranged in the groove adjacent one of the pivot pin end portions whereby the axial displacement of the pivot pin is delimited.

7. The articulation arrangement of claim 6, wherein the stop is elastically deformable for movement in a direction extending transversely to the longitudinal direction.

8. The articulation arrangement of claim 5, further comprising a holding extension projecting into the groove at the underside, the holding extension and groove defining a receiving chamber supporting one of the pivot pin end portions.

9. The articulation arrangement of claim 1, wherein the groove has a length exceeding the length of the pivot pin.

* * * * *